US006024654A

United States Patent [19]

Chun

[11] Patent Number: 6,024,654

[45] **Date of Patent: *Feb. 15, 2000**

[54] GOLF TEE SETTING APPARATUS

[76] Inventor: Won Ho Chun, 2007 Wren Way, Fullerton, Calif. 92833

[ * ] Notice: This patent is subject to a terminal disclaimer.

[21] Appl. No.: 09/061,885

[22] Filed: Apr. 17, 1998

Related U.S. Application Data

[63] Continuation-in-part of application No. 08/742,057, Oct. 31, 1996, Pat. No. 5,743,819.

[51] Int. Cl.[7] ..... A63B 57/00

[52] U.S. Cl. ..... 473/386; 473/397

[58] Field of Search ..... 473/386–463

[56] References Cited

U.S. PATENT DOCUMENTS

| | | | |
|---|---|---|---|
| 1,550,483 | 8/1925 | Wulkop . | |
| 1,616,059 | 2/1927 | Mulvehill | 473/394 |
| 1,783,733 | 12/1930 | Manassero . | |
| 1,803,907 | 5/1931 | Kruse . | |
| 1,936,625 | 11/1933 | Goldman | 473/390 |
| 2,079,387 | 5/1937 | Sickmiller | 473/398 |
| 3,540,727 | 11/1970 | Hoe, Jr. | 473/386 |
| 4,336,940 | 6/1982 | Sprague . | |
| 5,052,689 | 10/1991 | Letrich . | |
| 5,156,403 | 10/1992 | Martino . | |
| 5,413,348 | 5/1995 | Basso . | |
| 5,743,819 | 4/1998 | Chun | 473/386 |
| 5,766,100 | 6/1998 | Dilmore | 473/396 |

*Primary Examiner*—Steven Wong
*Attorney, Agent, or Firm*—Jonathan Y. Kang

[57] ABSTRACT

A golf tee setter according to the present invention allows golfers to use a real tee on a practice mat to practice their swing in golf driving ranges as if they are actually practicing on real ground. The golf tee setter is configured to be placed in the rubber tee hole of the practice mat and has a slit formed in a tee holder to hold the tee in substantially vertical position in relation to the practice mat to place a golf ball on the tee. The slit has a plurality of flaps extending from front and rear inner walls of the slit. The flaps are made of a flexible material to absorb any tilting force of the golf tee and prevents the golf tee from ejecting from the golf tee setter. The golf tee setter includes a base portion which has a slightly larger diameter than the body of the tee holder to enable the tee holder to be inserted into the practice mat from the top surface instead of from the bottom surface. In addition, a cord tethers the golf tee and the golf tee setter for repeated use of the golf tee.

20 Claims, 7 Drawing Sheets

GOLF TEE SETTING APPARATUS

This is a continuation-in-part of application Ser. No. 08/742,057 filed on Oct. 31, 1996, now U.S. Pat. No. 5,743,819.

BACKGROUND OF THE INVENTION

1. Field of the Invention

This invention relates to a golf tee setter, and more particularly, to an apparatus used in conjunction with golf tees and a practice mat to place a golf ball.

2. Description of Related Art

Golf is one of the most widely played sports activities in the United States. Not only is this activity already widespread, but the number of golfers continue to grow due to popularity of the sports caused by high stake games televised on televisions.

The sport of golf is typically played on a course consisting typically of eighteen holes. A set of clubs is used to strike a golf ball in each hole. Each hole has a tee box which defines a starting location of that hole in which a golfer places a golf ball and swings a golf club to strike the ball towards a designated green. Before striking the golf ball, the golfer first places a tee into the ground and then places a golf ball on the convex surface of the tee. Upon a proper impact of the golf ball with a club, the tee will either eject from the ground due to the impact of the club. In some instances, the impact of the club breaks the tee into two pieces rendering the tee unusable.

Typically, prior to playing on a golf course, golfers practice their swing in golf driving ranges which are equipped with artificial practice mats and rubber tees. The condition of the rubbers tees, such as their heights, varies among practice mats, and thus does not render optimum practicing condition for golfers. As a result, a golfer must adapt to such a condition to practice golf swings. For example, if a golfer desires a higher tee, such condition cannot be provided with a rubber tee, because its height is fixed for the particular practice mat. The reverse is also true if the golfer desires a lower tee. In addition, the condition of teeing off from a real tee, which is typically made of wood, cannot be emulated with a rubber tee.

In addition, existing rubber tees are fixed in height and are easily damaged when golf club heads hit golf balls. Also, rubber tees produce severe friction force against a golf ball because of a large contact surface area on the golf ball.

Further, conventional rubber tees are installed in the practice mat from the bottom. In other words, the practice mat must be lifted up first and then the rubber tee must be pushed in from the bottom of the practice mat. The weight of the practice mat make this task unnecessarily cumbersome.

SUMMARY OF THE DISCLOSURE

It is an object of the present invention to provide a golf tee setter for a practice mat to allow placing a tee in the tee setter to provide a golfer with an appropriate practice condition. With the present invention, golfers are able to use a real tee even on practice mats as if they would set it on actual golf field ground. Golfers can place a golf ball at any height. When the head of a golf club hits a golf ball, friction against the tee setter is almost eliminated and thus reducing damages to the tee setter.

According to one embodiment of the present invention, the golf tee setter includes a tee holder configured to be placed in the tee hole of the practice mat. The golf tee setter has a slit formed in a tee holder to hold the tee in substantially vertical position in relation to the practice mat to place a golf ball on the tee. There is at least one flap partially attached to an inner wall of the slit. The flap substantially prevents the tee from ejecting out of the slit. The tee holder has a body portion and a base portion. The base portion has a slightly larger diameter than the body portion and the tee hole to allow the body portion of the tee holder to be inserted into the tee hole.

Preferably, a lower half of the flap is secured to inner walls of the slit and substantially an upper half of the flap is freely bendable. The slit has front and rear walls, in which at least one flap extends from the front wall and at least one flap extends from the rear wall. The flap may extend at a predetermined angle offset from a perpendicular angle of the front wall. Similarly, another flap extends at the predetermined angle offset from a perpendicular angle of the rear wall. The predetermined angle is preferably approximately 10 degrees.

According to an aspect of the first embodiment of the present invention, there are three flaps extending substantially perpendicularly from the front wall and three flaps extending substantially perpendicularly from the rear wall. The flaps may manufactured to have various length. For example, the opposite facing flaps may be sufficient long to overlap with each other. Alternatively, the opposite facing flaps may be shorter than the one-half length of the slit to form a vertical gap in the middle of the slit.

According to a second embodiment of the present invention, in lieu of having three flaps extending from the front wall and another set of three flaps extending from the rear wall, there are three flaps extending only from the rear wall of the slit. These three flaps are longer in length and substantially extend the full length of the slit or longer than the full length of the slit. Alternatively, the flaps may be longer than the length of the slit.

According to a further aspect of the golf tee setting device, there is a cord having first end and second end which tethers the golf tee to the golf tee setter for repeated use of the golf tee. The cord may be elastic or non-elastic. The first end of the cord is of substantially a ring shape to insert the tee holder therein. The tee holder includes a groove formed on the outer circumferential surface to accommodate the first end of the cord. Similarly, the second end of the cord is of substantially a ring shape to insert the golf tee therein.

According to another aspect of the golf tee setting device, the height of the first member is substantially the same as the thickness of the practice mat.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
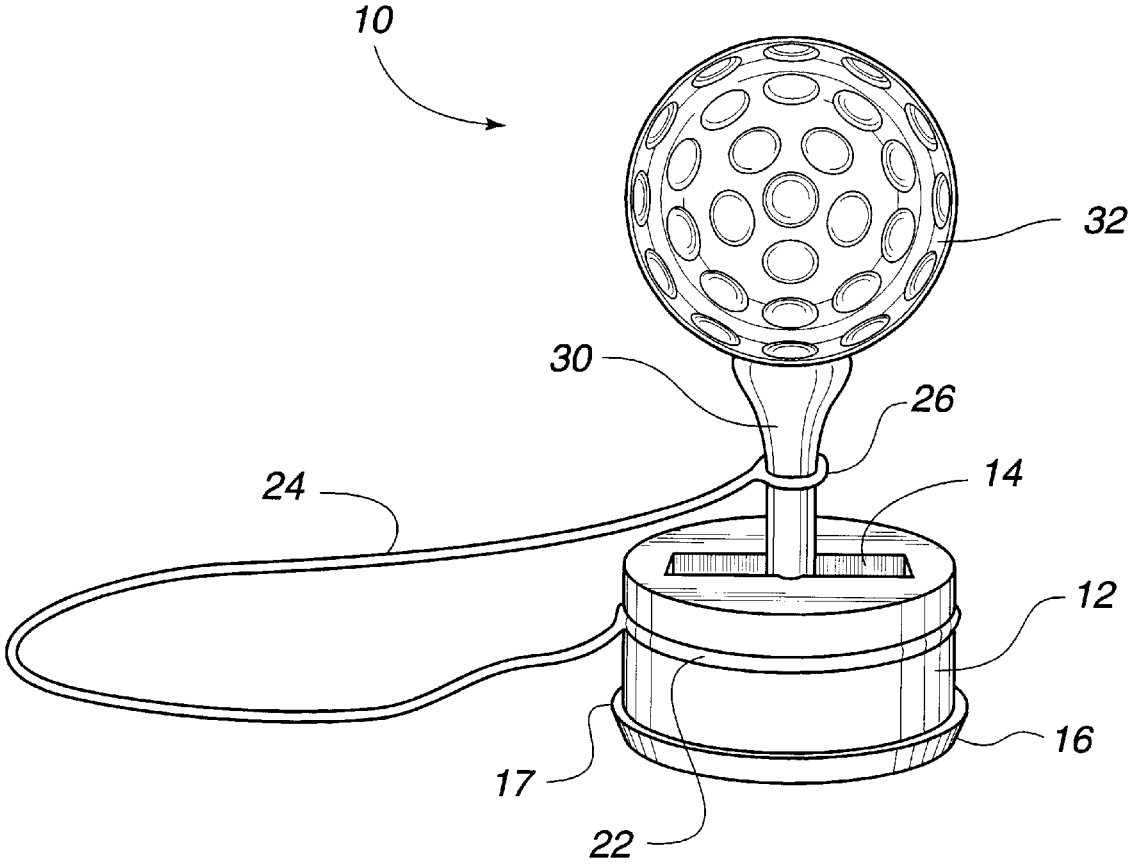
FIG. 1 illustrates a perspective view of a first embodiment of the golf tee setter.

A golf tee setter according to various embodiment of the present invention is shown in the drawings for purposes of illustration. In particular, a first embodiment of the present invention is illustrated in FIG. 1. According to this embodiment, the golf tee setter 10 includes a tee holder 12, a base 16, a slit 14 formed in the tee holder 12 and a cord 24.

The tee holder 12 which has a base 16 is typically disposed in a golf practice mat in a substantially upright position. The diameter of the base 16 is slightly larger than that of the tee holder 12 to permit the tee holder 12 to be inserted into a tee hole of the practice mat. The base 16 has substantially circular shape and is formed as an extended edge or fringe protruding out from the lower portion of the tee holder 12. The outer circumference 17 of the base 16 is slanted downward to allow the tee holder 12 to be easily inserted into a practice mat from the top, thus eliminating a cumbersome task of lifting the practice mat and installing the golf tee setter 10 from the bottom of the practice mat. Preferably, the tee holder 12 is molded of one-piece construction with the base 16, which may be integrally made with rubber or other flexible and resilient materials.

The tee holder 12 is of a cylindrical shape. The tee holder 12 has a slit 14 on the top which holds a tee 30 sufficiently tight to allow the placement of a golf ball 32 on the top of the tee 30. The tee holder 12 is preferably formed of a solid cylindrical member, in which the slit 14 extends all the way through the base 16 of the golf tee setter 10, as shown in FIG. 2.

The height of the golf tee holder assembly 10 is preferably the same as the height of practice mats in golf driving ranges so that the tee 30 will protrude above the surface of the practice mats. However, the golf tee holder assembly 10 may be of any desirable height. The diameter of the tee holder 12 is preferably slightly less than the diameter of the tee hole of the practice mat so that the tee holder 12 can snugly fit into the tee hole 21 (see FIG. 2) of the practice mat without tilting. The diameter of the base 16 should be slightly larger than the diameter of the hole of the practice mat so that the golf tee holder assembly 10 can be snugly inserted into the hole and does not slip out from the practice mat after each golf swing.

Figure 2:
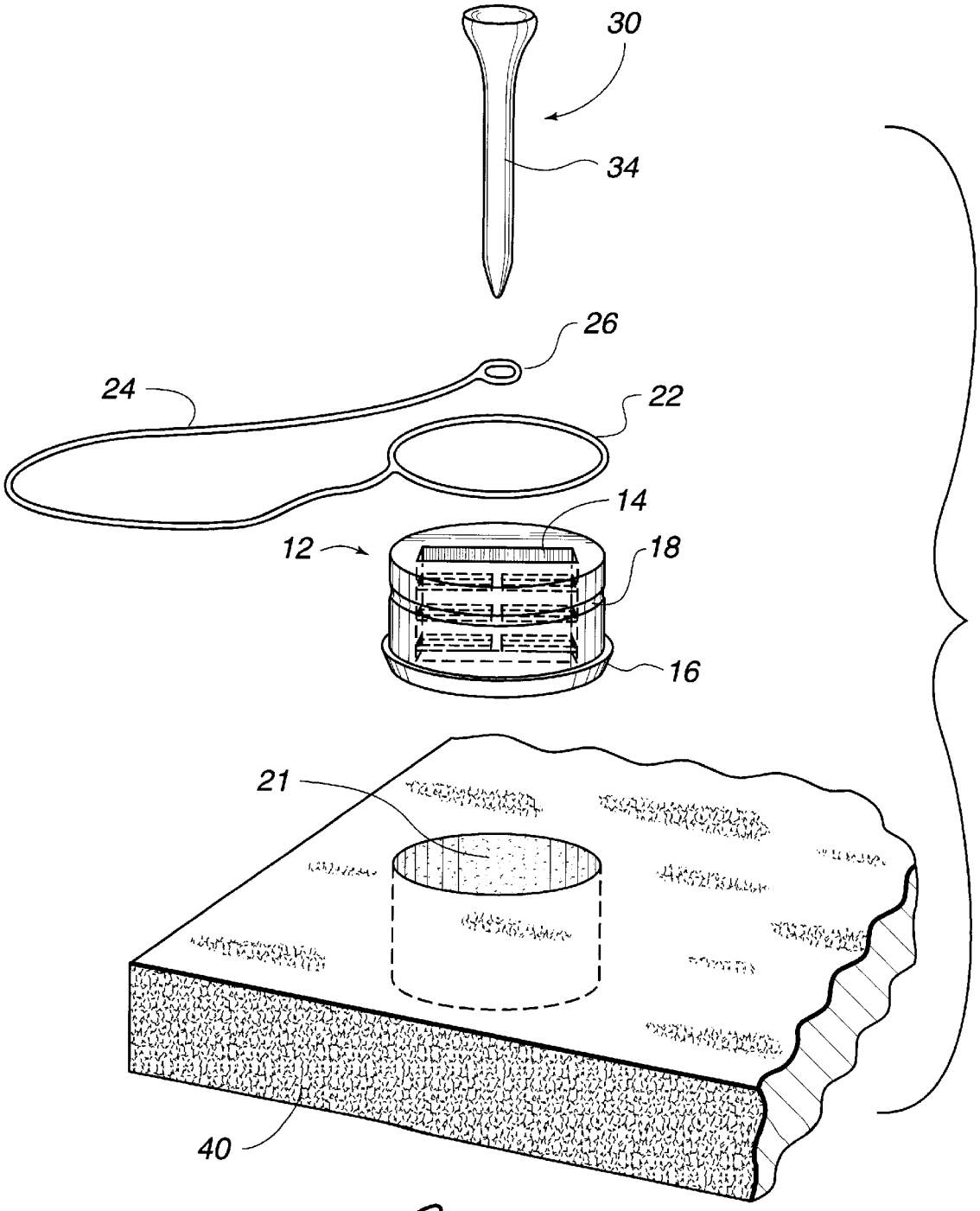
FIG. 2 illustrates an exploded view of FIG. 1.

FIG. 2 illustrates an exploded view of the first embodiment of the present invention. The practice golf tee setter 10 has a cord 24 having two ends 22 and 26. The first end 22 is coupled to the tee holder 12 and the second end 26 is coupled to the golf tee 30. The cord 24 is preferably made of an elastic and resilient material and is about 9–15 inches long. Alternatively, the cord 24 may be made of a non-elastic material, such as nylon, and the length may be longer to suit each individual's need. Moreover, the golf tee setter 10 may even be used without the cord 24.

In the first embodiment, the first end 22 slides onto a groove 18 formed on the outer circumference of the tee holder 12. Preferably, the groove 18 is formed on the substantially middle of the longitudinal length of the tee holder 12. However, the groove 18 may be formed on any place on outer circumference of the tee holder 12. Alternatively, the cord 24 may be coupled between the golf tee 30 and the tee holder 12 in any suitable manner, so long as the cord 24 can tether the golf tee 30 to the tee holder 12.

Because the first end 22 of the cord 24 is elastic, the first end 22 can be expanded when slid onto the tee holder 12 and will shrink back to its normal form and shape once it reached the groove 18. In the first embodiment of the present invention, the diameter of the second end 26 is slightly smaller than a typical diameter of the spike portion 34 of the tee 30. Such configuration allows the second end 26 of the cord 24 to tightly slide onto the spike portion 34 of the tee 30.

Figure 3A:
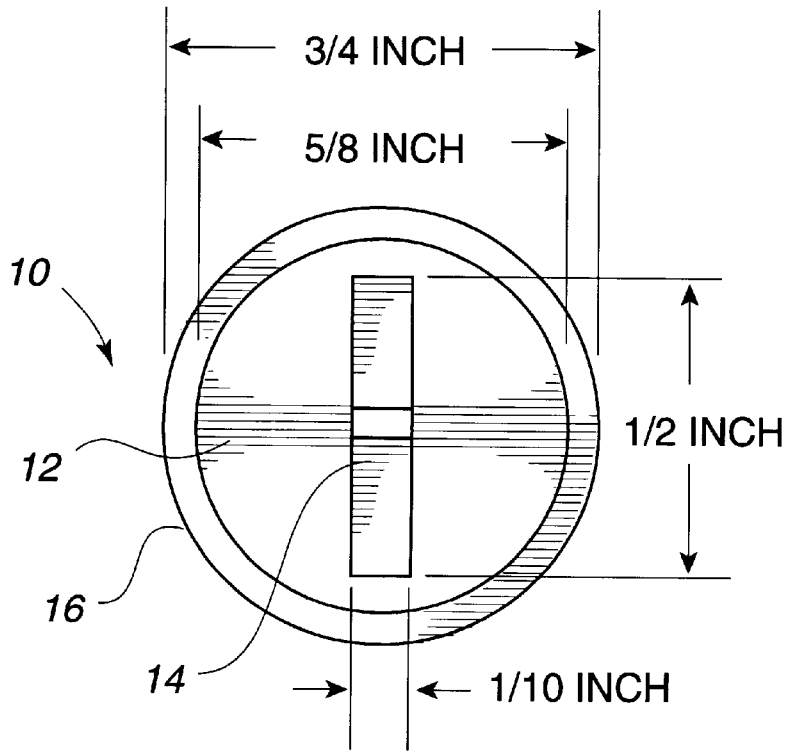
FIG. 3*a* illustrates a top plan view of the first embodiment of the present invention.

The physical configuration and construction of the first embodiment of the present invention will now be described with reference to FIG. 3*a*. As shown in FIG. 3*a*, which illustrates a top plan view of the first embodiment, the diameter of the base 16 is approximately ¾ inches and the diameter of the cylindrical tee holder 12 is approximately ⅝ inches. The diameter of the tee holder 12 may be changed to fit the holes formed in the practice mats to accommodate conventional rubber tees. If so, the length of the slit 14 and the diameter of the base 16 should be changed accordingly. The diameter of the base 16 is larger than that of the tee holder 12 so that the tee setter 10 remains in the practice mat after each golf swing.

FIG. 3*a* further illustrates the substantially rectangular slit 14. The width of the rectangular slit 14 is sufficiently small to tightly hold a regular size golf tee. The rectangular slit 14 is formed within the tee holder 12 and has a dimension of approximately ½ inches by 1/10 inches. The rectangular slit 14 is configured to tilt the golf tee 30 when a golf club head makes an impact with the golf ball placed on the tee 30. It should be understood that the present invention is not be limited to the particular shapes of the slit 14 mentioned above, because many other shapes can be used to form the slit by present invention.

Figure 3B:
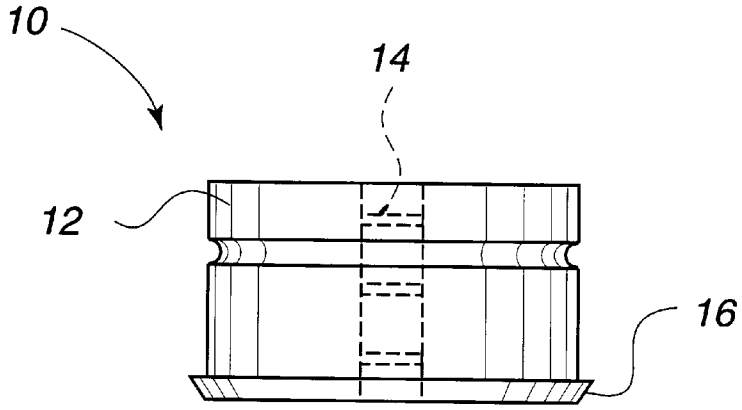
FIG. 3*b* illustrates a front elevational view of the first embodiment of the present invention.

FIG. 3*b* illustrates a front elevational view of the first embodiment of the present invention. The vertical dotted lines indicate the length of the rectangular slit 14, which extends all the way down to the base 16. The horizontal dotted lines indicate flaps which are described below. The first embodiment has an open bottom end to allow the users to easily clean the inside of the slit 14. As shown in FIG. 3*b*, the height of the golf tee setter 10 is substantially the same as the height of the practice mat to simulate a smooth hitting surface.

Figure 4:
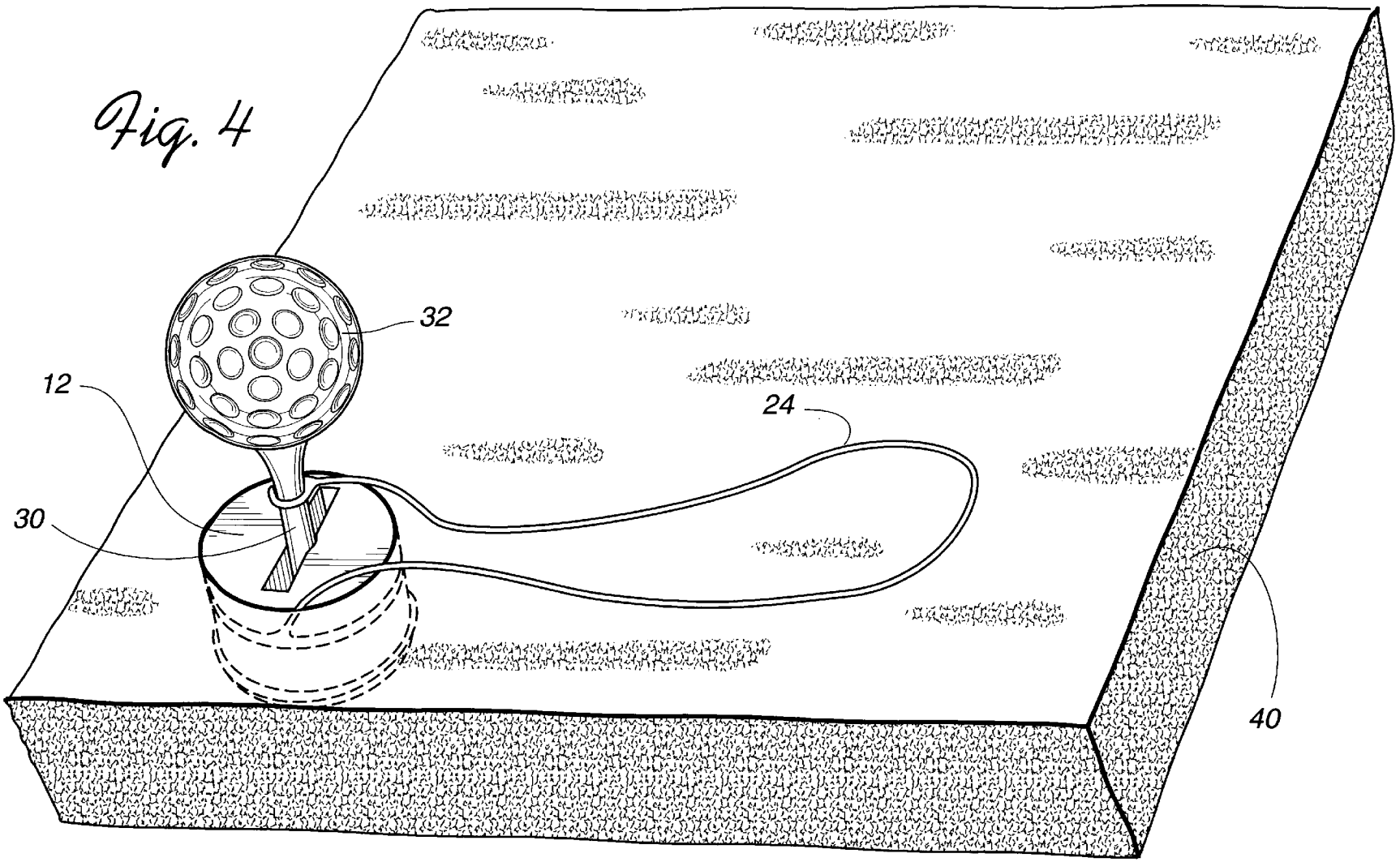
FIG. 4 illustrates a perspective view of the first embodiment of the present invention placed in a practice mat.

FIG. 4 illustrates a view of the first embodiment of the present invention placed in the practice mat 40. The tee holder 12 is inserted into the tee hole defined by the practice mat 40 so that when a golf tee 30 is placed into the rectangular slit 14, the only members exposed to a golf club is a tee 30 and a golf ball 32.

Figure 5:
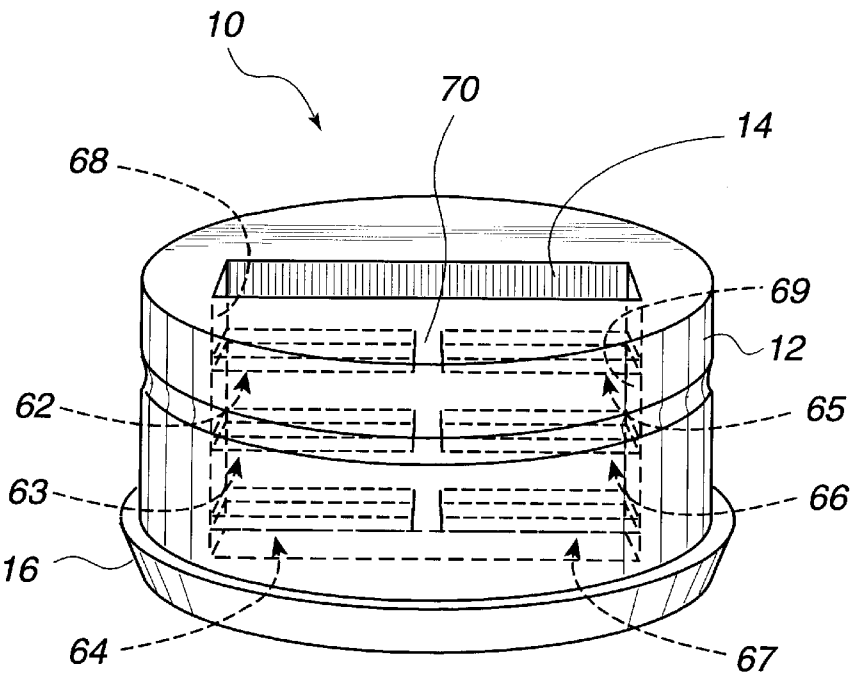
FIG. 5 illustrates an internal perspective view of the first embodiment of the present invention.

FIG. 5 illustrates a perspective view of the first embodiment of the golf tee setter 10. In particular, FIG. 5 illustrates the internal structure of the slit 14 of the tee holder 12. Inside the slit 14, there provided are six flaps 62–67. Each flap is preferably in a shape of a thin rectangular bar made of a flexible and resilient material, such as rubber or plastic, etc. Each flap is partially attached to the inner walls of the slit 14. The flaps 62–67 are preferably made with the same material as the tee holder 12 and can be made as a single integral piece as the other parts of the golf tee setter 10.

Each flap extends from the front 69 or rear 68 wall of the slit 14 to substantially the middle of the slit 14, where a golf tee is preferably positioned. FIG. 5 illustrates the flaps 62–67 which form a gap 70 for installing a golf tee. Alternatively, the flaps 62–67 may be longer in length so that the gap 70 is minimized or does not exist at all. The flaps 62–67 may also be sufficiently long to overlap with respect to each other. In such construction, the golf tee can still be installed in the slit 14 since the loose portions of the flaps flexibly accommodate the golf tee.

The lower half of the flaps 62–67 is attached to the front 69 and rear 68 walls of the slit 14 and the upper half is not. The flexible flaps 62–67 prevent the golf tee from ejecting out of the slit 14 when the golf tee is struck by a golf club. For example, when a golf club makes an impact with a golf ball placed on the tee held in the slit 14 of the golf tee setter 12, the golf tee is forced to tilt in the swing direction of the golf club. Without the flaps 62–67, the golf tee can easily eject out of the tee holder 12 due to the force of the impact. However, with the built-in flaps 62–67, where each one of them is partially attached to the inner walls of the slit 14, the golf tee is prevented from ejecting out of the slit 14. Because of the loose ends of the flaps 62–67, substantially all of the ejection force will be absorbed by the flaps 62–67.

Although FIG. 5 illustrates six flaps 62–67 substantially perpendicularly extending from the front 69 and rear 68 walls of the slit 14, the flaps 62–67 may alternatively be constructed to be slanted slightly downward by approximately 5–10 degrees to maximize the ejection prevention effect of the flaps 62–67. The angled flaps will be more effective in preventing the golf tee from ejecting from the tee holder 12. Moreover, the position of the flaps 62–67 may be changed with respect to the front 69 and rear 68 walls of the slit 14. For example, instead of having the three flaps 65–67 from the front wall 69 being at the same vertical positions as the three flaps 62–64 of the rear wall 68, the positioning of the flaps may be staggered or interleaved so that each flap is positioned at a different vertical position with respect to the bottom of the slit 14.

Alternative to having six flaps 62–67 in the slit 14, three on each front and rear wall, the slit 14 may have two flaps or even one flap on the front 69 and rear 68 walls. During manufacturing, the any number of flaps may be placed along any vertical position of the slit 14. For example, there may be only two flaps 62 and 65 protruding in the slit 14 in which the flaps 62 and 65 are placed at the top most portion of the slit 14 flush with the upper surface of the golf tee holder assembly 10.

Figure 6:
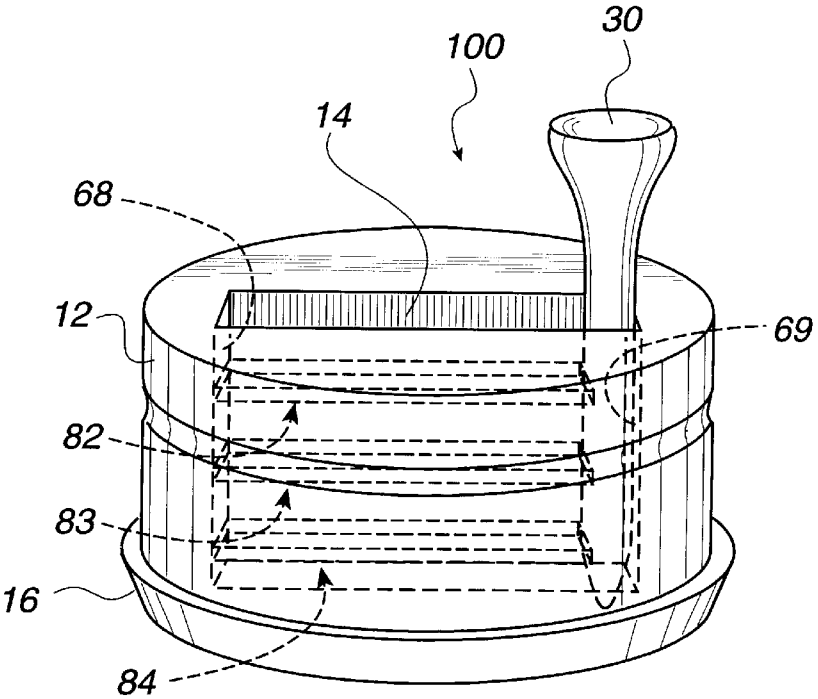
FIG. 6 illustrates an internal perspective view of a second embodiment of the present invention.

FIG. 6 illustrates a second embodiment of the golf tee setter 100. Instead of having six flaps 62–67 in the slit 14, three flaps on each front and front wall, the golf tee setter 100 according to the second embodiment has only three flaps 82–84 attached to the rear wall 68 of the slit 14. The length of each flap is preferably longer since only three flaps 82–84 extend from the rear wall 68. In the second embodiment, the golf tee 30 is placed substantially toward and adjacent to the front wall 69 of the slit 14. The golf tee 30 is supported between the front wall 69 and the three flaps 82–84, as well as the side walls of the slit 14. When the golf club make an impact with the golf tee 30, the bottom portion of the golf tee is tilted toward the rear wall 68 of the slit 14. The flexible flaps 82–84 are in turn folded upward thereby absorbing most of the tilting force of the golf tee 30. As a result, the golf tee 30 remains in the slit 14.

Instead of having three flaps 82–84 inside the slit 14 substantially perpendicularly extending from the rear 68 wall, the flaps 82–84 may be constructed to be slanted slightly downward by approximately 5–10 degrees to maximize the ejection prevention effect of the flaps 82–84. The angled flaps will be more effective in preventing the golf tee from ejecting from the tee holder 12. Alternative to having three flaps 82–84 attached to the rear wall 68 of the slit 14, there may be two or even one flap extending from the rear wall 68.

Figure 7:
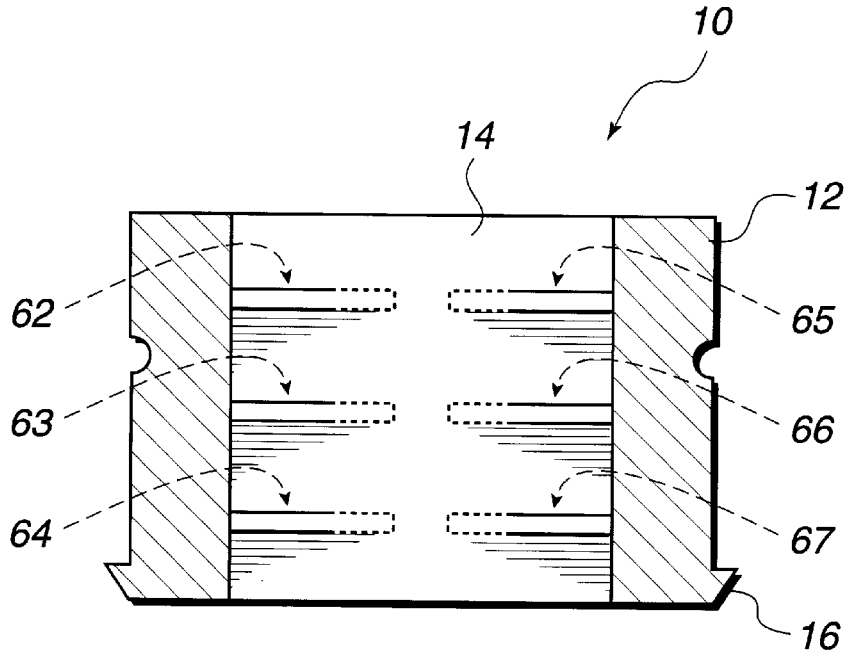
FIG. 7 illustrates a cross-sectional view of FIG. 5.

FIG. 7 illustrates a cross-sectional view of FIG. 5. The flexible flaps 62–67 are shown in the slit 14. In the flaps 62–67, the solid lines illustrate the lower portion of each flap which is attached to or is integral member of the inner walls of the slit 14. The dotted lines of the flaps 62–67 illustrate the upper portion which are not attached to the inner walls of the slit 14 and thus freely moveable. The unattached upper portion of the flaps 62–67 are flexible, and thus, allows the golf tee to tilt at the same time preventing it from ejecting out of the tee holder 12.

Figure 8:
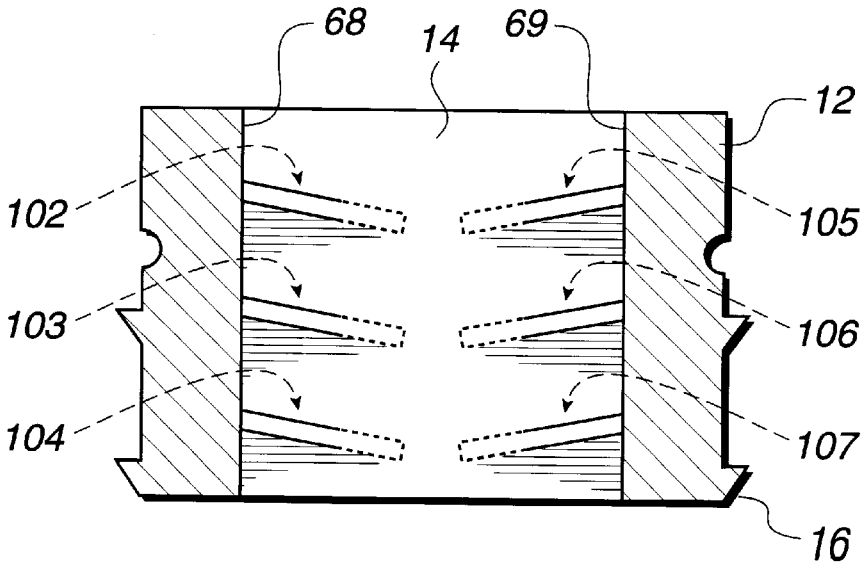
FIG. 8 illustrates a cross-sectional view of another embodiment of the present invention.

FIG. 8 illustrates a cross-sectional view of yet another embodiment of the present invention. As described above, the flaps 102–107 are extended from the front 69 and rear 68 walls of the slit 14 at an angle of about 5–10 degrees. This slanted construction provides enhanced performance of the flaps in preventing the golf tee from ejecting from the tee holer 12.

In addition, FIG. 8 shows a ring 110 which protrudes around the circumference of the tee holder 12. The ring 110 may be of any shape. Preferably, the ring 110 has an upward edge to prevent the tee holder 12 from ejecting out of the tee hole of the practice mat. The upward edge of the ring 110, which is made of the same flexible rubber like material as the rest of the body, is constructed so that the ring 110 bends downward when the golf tee setter 100 is pulled from the practice mat. There may be more than one such ring 110 on the outer circumference of the tee holder 12.

Figure 9:
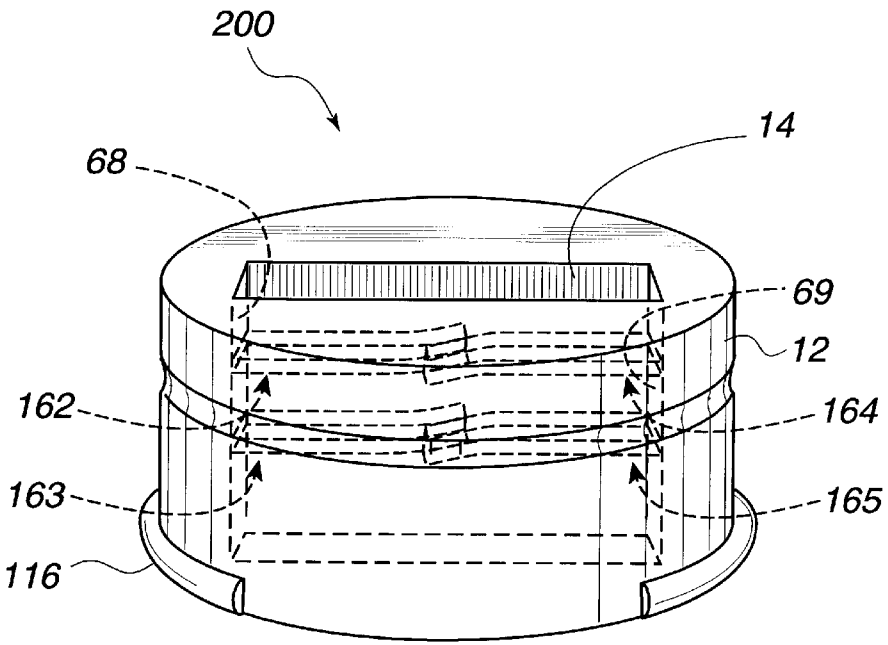
FIG. 9 illustrates an internal perspective view of an embodiment of the present invention having overlapping flaps.

FIG. 9 illustrates a still another embodiment of the golf tee setter 200. FIG. 9 is similar to FIG. 5 in many respects except that the four flaps 162–165 are disposed in overlapping manner. In particular, the flaps 162 and 164 are sufficiently long to overlap with respect to each other, while the flaps 163 and 165 are overlapping with respect to each other. Because only the lower half of the flaps are secured to the wall of the slit 14, a golf tee 30 can be placed in between the overlapping flaps.

FIG. 9 also shows a ring 116 which protrudes out of the body of the golf tee setter. The ring 116 does not have an upward edge like the ring 110 of FIG. 5 or 6. The shape of the ring 116 allows a golfer to easily insert and remove the golf tee setter 200 into and from the practice mat. In addition, in lieu of a ring which fully covers the circumference of the cylindrical tee holder 12 of the golf tee setter 200, the ring 116 covers only portions of the cylindrical tee holder 12. Preferably, there are two ring 116 segments disposed in the front and back of the tee holder 12, as shown in FIG. 9.

Figure 10:
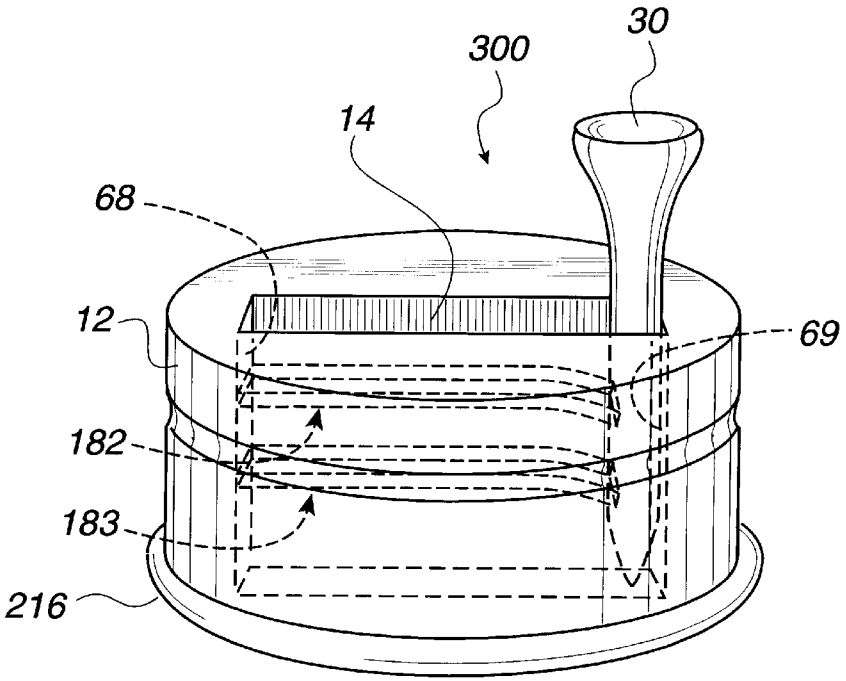
FIG. 10 illustrates an internal perspective view of a further embodiment of the present invention having flaps which are longer than the length of a slit.

The golf tee setter 300 shown in FIG. 10 illustrates yet another embodiment of the present invention. The golf tee setter 300 has two long flaps 182 and 183 attached to the rear wall 68 of the slit 14. The length of each flap is preferably longer than the length of the slit 14 so that when the golf tee 30 is inserted the tips of the flaps 182 and 183 are bent downwards. The ring 216 of the golf tee setter 300 covers the entirely circumference of the tee holder 12 without the presence of an upward edge like the ring 110 of FIG. 5 or 6. Although the ring 216 is placed at the lower most edge of the tee setter 12 in FIG. 10, the ring 216 may be placed any where on the outer surface of the tee setter 12.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf tee setting device for use with a tee and a practice mat having a tee hole, the golf tee setting device comprising:

a tee holder configured to be placed in the tee hole of the practice mat, wherein the tee holder has a solid interior;

a slit lengthwise formed in the tee holder and extending through the solid interior to hold the tee in a substantially vertical position in relation to the practice mat; and at least one flap partially attached to an inner wall of the slit to extend along the lengthwise opening of the slit, wherein the flap substantially prevents the tee from ejecting out of the slit.

2. A golf tee setting device of claim 1, the tee holder further comprising a body portion and a base portion, wherein the base portion has a slightly larger diameter than that of the body portion and that of the tee hole to allow the body portion of the tee holder to be snugly inserted into the tee hole.

3. A golf tee setting device of claim 1, wherein a lower portion of the flap is affixed to the inner wall of the slit and an upper portion of the flap is loose.

4. A golf tee setting device of claim 1, the slit further comprising front and rear walls, wherein at least one flap extends from the front wall and at least one flap extends from the rear wall.

5. A golf tee setting device of claim 4, wherein the flap from the front wall and the flap from the rear wall extend substantially to a middle of the slit.

6. A golf tee setting device of claim 4, wherein the flap from the front wall and the flap from the rear wall overlap with respect to each other.

7. A golf tee setting device of claim 1, the slit further comprising front and rear walls, wherein at least one flap extends at a predetermined angle offset from a perpendicular angle of the front wall and at least one flap extends at the predetermined angle offset from a perpendicular angle of the rear wall.

8. A golf tee setting device of claim 7, wherein the predetermined angle is approximately 10 degrees.

9. A golf tee setting device of claim 1, the slit further comprising front and rear walls, wherein at least one flap extends from the rear wall.

10. A golf tee setting device of claim 9, wherein the flap from the rear wall is longer than a length of the slit.

11. A golf tee setting device of claim 1, the slit further comprising front and rear walls, wherein at least one flap extends at a predetermined angle offset from a perpendicular angle of the rear wall.

12. A golf tee setting device of claim 11, wherein the predetermined angle is approximately 10 degrees.

13. A golf tee setting device of claim 9, wherein the flap extends substantially from the rear wall to the front wall.

14. A golf tee setting device of claim 1, wherein the height of the golf tee setting device is substantially the same as the thickness of the practice mat.

15. A golf tee setting device of claim 1, wherein the slit is sized to hold the golf tee sufficiently tight to hold the tee in substantially vertical position in relation to the practice mat.

16. A golf tee setting device of claim 2, the base portion of the tee holder has an outer wall which is slanted to allow easy insertion of the tee holder into the tee hole but is bias against from ejecting out of the tee hole.

17. A golf tee setting device of claim 1, the tee holder has at least one ring formed at least partially on an outer circumference of the tee holder, wherein the ring has a slightly larger diameter than that of the tee holder and that of the tee hole to allow the tee holder to be snugly inserted into the tee hole.

18. A golf practice apparatus for use with a tee and a golf ball, the golf tee setting device comprising:

a mat defining a tee hole;

a tee holder configured to be placed in the tee hole of the mat, wherein the tee holder has a solid interior;

a slit lengthwise formed in the tee holder and extending through the solid interior to hold the tee in substantially vertical position in relation to the mat to place the golf ball on the tee; and at least one flap partially attached to an inner wall of the slit to extend along the lengthwise opening of the slit, wherein the flap substantially prevents the tee from ejecting out of the slit.

19. A golf tee setting device of claim 18, wherein a lower portion of the flap is affixed to the inner wall of the slit and an upper portion of the flap is loose.

20. A golf tee setting device of claim 18, the slit further comprising front and rear walls, wherein at least one flap extends from the front wall and at least one flap extends from the rear wall.

* * * * *